US011682243B2

(12) United States Patent
Inagaki

(10) Patent No.: US 11,682,243 B2
(45) Date of Patent: Jun. 20, 2023

(54) DRIVING ASSISTANCE DEVICE, DRIVING ASSISTANCE METHOD, AND PROGRAM

(71) Applicant: NEC CORPORATION, Tokyo (JP)

(72) Inventor: Kazuki Inagaki, Tokyo (JP)

(73) Assignee: NEC CORPORATION, Tokyo (JP)

( * ) Notice: Subject to any disclaimer, the term of this patent is extended or adjusted under 35 U.S.C. 154(b) by 291 days.

(21) Appl. No.: 16/662,622

(22) Filed: Oct. 24, 2019

(65) Prior Publication Data

US 2020/0134943 A1 Apr. 30, 2020

(30) Foreign Application Priority Data

Oct. 26, 2018 (JP) ..... JP2018-201589

(51) Int. Cl.
*G07C 5/08* (2006.01)
*G07C 5/02* (2006.01)

(52) U.S. Cl.
CPC ..... *G07C 5/0808* (2013.01); *G07C 5/02* (2013.01); *G07C 5/085* (2013.01)

(58) Field of Classification Search
CPC ..... G07C 5/0808; G07C 5/02; G07C 5/085
See application file for complete search history.

(56) References Cited

U.S. PATENT DOCUMENTS 10,387,962 B1 * 8/2019 Potter ..... B60R 25/102
10,431,089 B1 * 10/2019 Nguyen ..... G07C 5/02
2007/0040705 A1 * 2/2007 Yoshioka ..... G08G 1/0969 340/988
2012/0197481 A1 * 8/2012 Takeda ..... B60W 50/0205 701/31.4
2015/0336547 A1 * 11/2015 Dagan ..... B60T 8/171 701/70
2017/0291615 A1 * 10/2017 Kusano ..... G07C 5/0825
2018/0070058 A1 * 3/2018 Yonekawa ..... H04N 7/183
2018/0293809 A1 * 10/2018 James ..... H04W 4/38
(Continued)

FOREIGN PATENT DOCUMENTS

JP 2006258428 A * 9/2006
JP 2008-116294 A 5/2008
JP 2013-140448 A 7/2013
(Continued)

OTHER PUBLICATIONS

Japanese Office Action for JP Application No. 2018-201589 dated Mar. 2, 2021 with English Translation.

*Primary Examiner* — Behrang Badii
*Assistant Examiner* — Jay Khandpur
(74) *Attorney, Agent, or Firm* — Sughrue Mion, PLLC

(57) ABSTRACT

A driving assistance device includes a first acquisition unit that acquires hazardous event data for notifying the occurrence of a hazardous event during driving from a driving situation sensing device provided in a vehicle, a second acquisition unit that acquires a deterioration degree of a traveling environment registered in advance in association with a position where the driving situation sensing device senses the hazardous event data, and a determination unit that determines, on a basis of the hazardous event data and the deterioration degree of the traveling environment, whether a hazardous event indicated by the hazardous event data was caused by a driving operation of the driver of the vehicle or the traveling environment.

7 Claims, 10 Drawing Sheets

<RUT>

| DETERIORATION DEGREE | HAZARDOUS EVENT TYPE | | |
|---|---|---|---|
| | SUDDEN STEER | BUMP | OTHER |
| LOW | DRIVER | DRIVER | DRIVER |
| MEDIUM | ROAD | DRIVER | DRIVER |
| HIGH | ROAD | ROAD | DRIVER |

<CRACK>

| DETERIORATION DEGREE | HAZARDOUS EVENT TYPE | |
|---|---|---|
| | BUMP | OTHER |
| LOW | DRIVER | DRIVER |
| MEDIUM | DRIVER | DRIVER |
| HIGH | ROAD | DRIVER |

(56) References Cited

U.S. PATENT DOCUMENTS

2021/0166323 A1* 6/2021 Fields ..... H04W 4/024

FOREIGN PATENT DOCUMENTS

| | | | | |
|---|---|---|---|---|
| JP | 2017111726 | A | * | 6/2017 |
| JP | 2017-151546 | A | | 8/2017 |
| JP | 2019054480 | A | * | 4/2019 |
| WO | 2016/157304 | A1 | | 10/2016 |

* cited by examiner

FIG. 6A

<CRACK>

| DETERIORATION DEGREE | DETERIORATION CONDITION |
|---|---|
| LOW | CRACK RATIO 0~20% |
| MEDIUM | CRACK RATIO 20~40% |
| HIGH | CRACK RATIO 40% AND ABOVE |

FIG. 6B

<POTHOLE>

| DETERIORATION DEGREE | DETERIORATION CONDITION |
|---|---|
| LOW | NO POTHOLES |
| HIGH | POTHOLES PRESENT |

FIG. 6C

<RUT>

| DETERIORATION DEGREE | DETERIORATION CONDITION |
|---|---|
| LOW | RUT DIGGING AMOUNT 0~20 MM |
| MEDIUM | RUT DIGGING AMOUNT 20~40 MM |
| HIGH | RUT DIGGING AMOUNT 40 MM AND ABOVE |

FIG. 7A

<RUT>

| DETERIORATION DEGREE | HAZARDOUS EVENT TYPE | | |
|---|---|---|---|
| | SUDDEN STEER | BUMP | OTHER |
| LOW | DRIVER | DRIVER | DRIVER |
| MEDIUM | ROAD | DRIVER | DRIVER |
| HIGH | ROAD | ROAD | DRIVER |

FIG. 7B

<CRACK>

| DETERIORATION DEGREE | HAZARDOUS EVENT TYPE | |
|---|---|---|
| | BUMP | OTHER |
| LOW | DRIVER | DRIVER |
| MEDIUM | DRIVER | DRIVER |
| HIGH | ROAD | DRIVER |

DRIVING ASSISTANCE DEVICE, DRIVING ASSISTANCE METHOD, AND PROGRAM

INCORPORATION BY REFERENCE

This application is based upon and claims the benefit of priority from Japanese patent application No. 2018-201589, filed Oct. 26, 2018, the disclosure of which is incorporated herein in its entirety by reference.

BACKGROUND OF THE INVENTION

Field of the Invention

The present invention relates to a driving assistance device, a driving assistance method and a program thereof.

Description of Related Art

Patent Document 1 (Japanese Unexamined Patent Application No. 2017-151546) and Patent Document 2 (Japanese Unexamined Patent Application No. 2008-116294) disclose techniques for determining a hazardous driving level of a driver who is driving a mobile body such as a vehicle.

Patent Document 1 discloses making a determination of a hazardous driving level of a driver of a vehicle on the basis of acquired vehicle information and environmental information and, in accordance with the determined hazardous driving level, presenting to the driver advice information for prompting safe driving.

Patent Document 2 discloses a technique for measuring the flatness, rutted depth, and crack rate of a road surface, which serve as references for performing repairs to the road surface.

There is a demand for a technique of performing driving assistance related to hazardous driving with higher accuracy using a sensing device for driving situations as described above.

SUMMARY OF THE INVENTION

Therefore, an object of the present invention is to provide a driving assistance device, a driving assistance method and a program thereof that solve the above-described problems.

According to the first aspect of the present invention, a driving assistance device includes a first acquisition unit that acquires hazardous event data for notifying the occurrence of a hazardous event during driving from a driving situation sensing device provided in a vehicle; a second acquisition unit that acquires a deterioration degree of a traveling environment registered in advance in association with a position where the driving situation sensing device senses the hazardous event data; and a determination unit that determines, on a basis of the hazardous event data and the deterioration degree of the traveling environment, whether a hazardous event indicated by the hazardous event data was caused by a driving operation of the driver of the vehicle or the traveling environment.

According to the second aspect of the present invention, a driving assistance method includes acquiring hazardous event data for notifying the occurrence of a hazardous event during driving from a driving situation sensing device provided in a vehicle; acquiring a deterioration degree of a traveling environment registered in advance in association with a position where the driving situation sensing device senses; and determining, on a basis of the hazardous event data and the deterioration degree of the traveling environment, whether a hazardous event indicated by the hazardous event data was caused by a driving operation of the driver of the vehicle or the traveling environment.

According to a third aspect of the present invention, a non-transitory computer-readable recording medium storing a program causes a computer of a driving assistance device to perform processes, the processes includes acquiring hazardous event data for notifying the occurrence of a hazardous event during driving from a driving situation sensing device provided in a vehicle; acquiring a deterioration degree of a traveling environment registered in advance in association with a position where the driving situation sensing device senses the hazardous event data; and determining, on a basis of the hazardous event data and the deterioration degree of the traveling environment, whether a hazardous event indicated by the hazardous event data was caused by a driving operation of the driver of the vehicle or the traveling environment.

Effects of the Invention

According to the present invention, driving assistance related to hazardous driving can be performed with higher accuracy.

BRIEF DESCRIPTION OF THE DRAWINGS

FIG. 6A to 6C are a diagram for explaining the deterioration degree of the traveling environment according to the present embodiment.

FIGS. 7A and 7B are a diagram showing determination tables according to the present embodiment.

DETAILED DESCRIPTION OF THE INVENTION

Hereinafter, a driving assistance device according to an embodiment of the present invention will be described with reference to the drawings.

Figure 1:
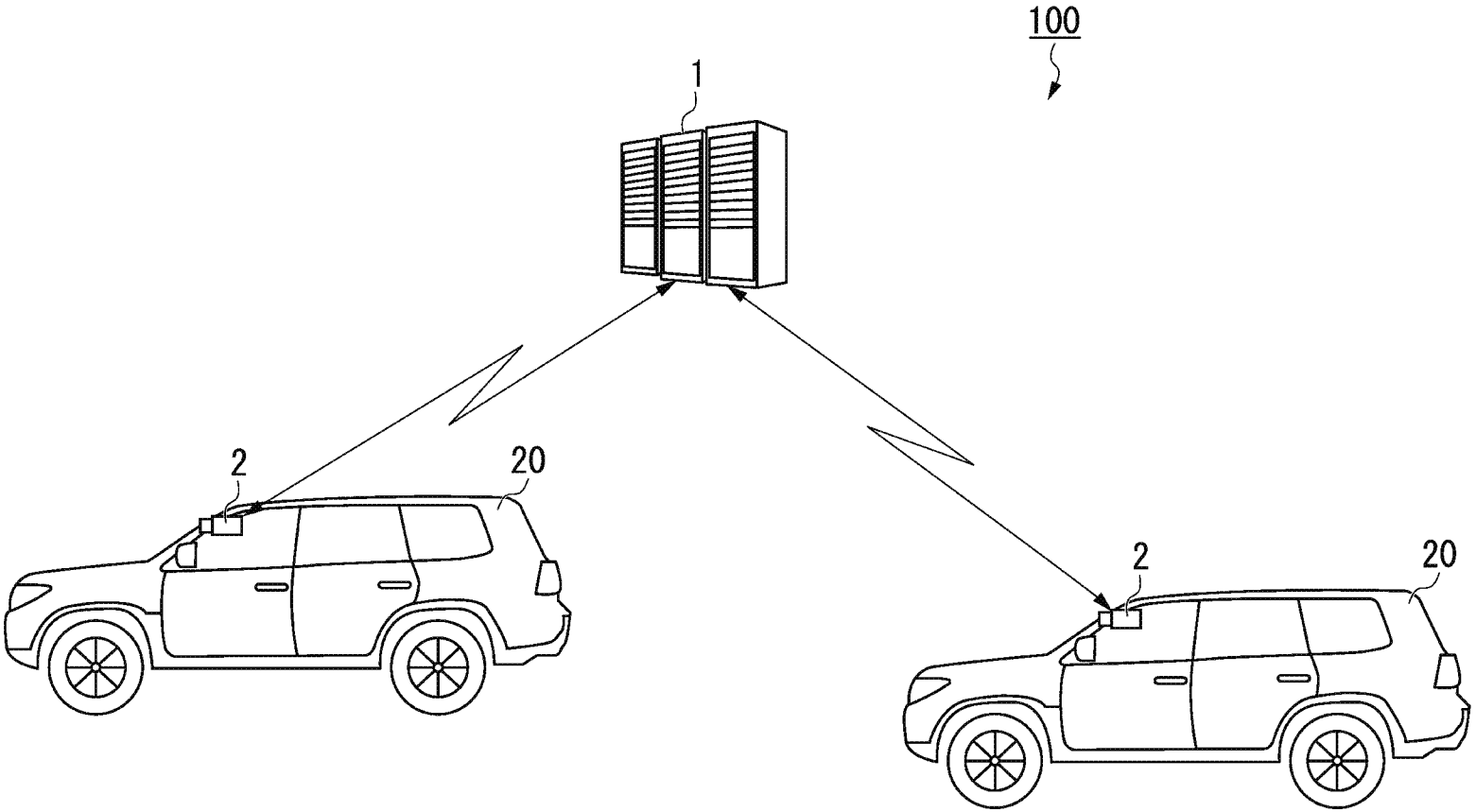
FIG. 1 is a diagram showing an outline of a driving assistance system according to the present embodiment.

FIG. 1 is a diagram showing an outline of a driving assistance system including a driving assistance device according to the present embodiment.

As shown in FIG. 1, the driving assistance system 100 is configured by a driving assistance device 1 and a drive recorder 2 being connected via a wireless communication network or a wired communication network. The driving assistance device 1 is, for example, a computer server (cloud server) installed by a business operator that provides driving assistance and is connected to a communication network. The drive recorder 2 is provided in each of a plurality of mobile bodies. In FIG. 1, a description is given using a vehicle 20 as an example of the mobile body. The mobile body may include an autonomous driving vehicle. The drive recorder 2 has a camera and transmits to the driving assistance device 1 captured images obtained by capturing images of the outside of the vehicle 20. The drive recorder 2 is one aspect of a driving situation sensing device.

Figure 2:
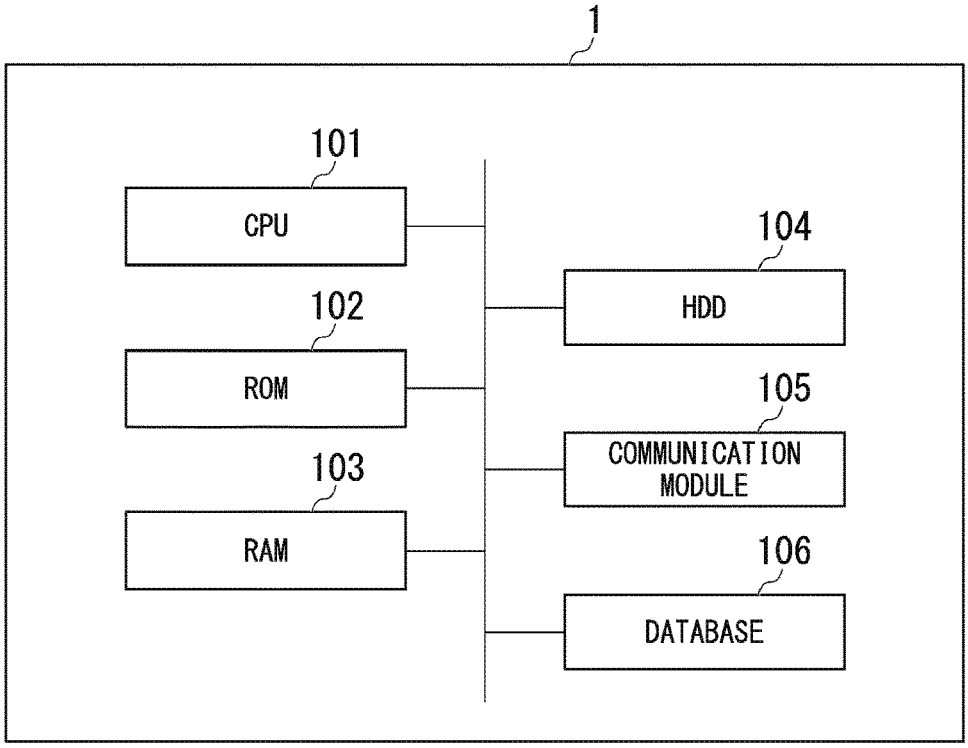
FIG. 2 is a hardware configuration diagram of the driving assistance device according to the present embodiment.

FIG. 2 is a hardware configuration diagram of the driving assistance device.

As shown in this drawing, the driving assistance device 1 is a computer provided with hardware including a CPU (Central Processing Unit) 101, a ROM (Read Only Memory) 102, a RAM (Random Access Memory) 103, an HDD (Hard Disk Drive) 104, a communication module 105, and a database 106.

Figure 3:
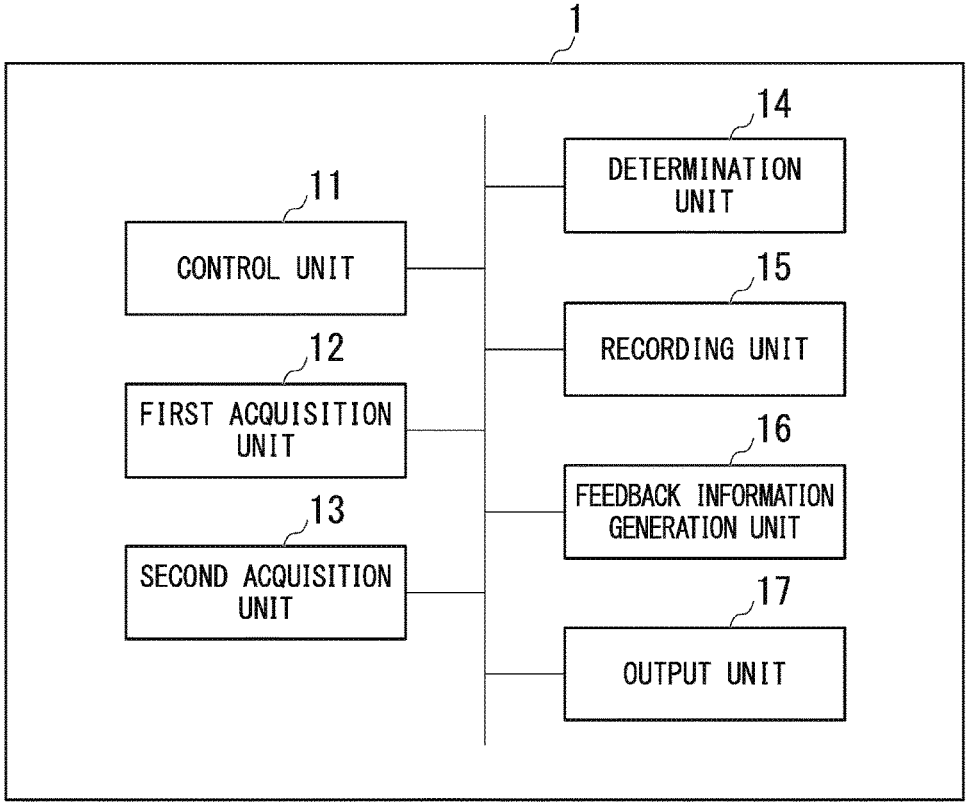
FIG. 3 is a function block drawing of the driving assistance device according to the present embodiment.

FIG. 3 is a function block drawing of the driving assistance device.

The driving assistance device 1 starts when the power is turned on and executes a driving assistance program stored in advance. Accordingly, the driving assistance device 1 includes a control unit 11, a first acquisition unit 12, a second acquisition unit 13, a determination unit 14, a recording unit 15, a feedback information generation unit 16, and an output unit 17.

The control unit 11 controls other function units of the driving assistance device 1.

The first acquisition unit 12 acquires hazardous event data for notifying the occurrence of a hazardous event during driving from the driving situation sensing device such as the drive recorder 2 provided in the vehicle 20.

The second acquisition unit 13 acquires, from a database 106 or the like of the device, deterioration information of a traveling environment registered in advance in association with a position where the driving situation sensing device sensed the hazardous event data.

The determination unit 14 determines, on the basis of the hazardous event data and the deterioration information of the traveling environment, whether a hazardous event indicated by the hazardous event data was caused by a driving operation of the driver of the vehicle 20 or the traveling environment.

The recording unit 15 records the determination result of the determination unit 14 and the like.

The feedback information generation unit 16 generates information for feeding back the determination result to the driver.

The output unit 17 outputs the feedback information to a predetermined output destination device. The output destination device may be a terminal of a company to which the driver belongs.

By being provided with each function unit as described above, the driving assistance device 1 acquires deterioration information of the traveling environment registered in advance that associates hazardous event data with the sensed position. Then, on the basis of the hazardous event data and the deterioration information of the traveling environment, the driving assistance device 1 determines whether a hazardous event indicated by the hazardous event data was caused by a driving operation of the driver of the vehicle or the traveling environment.

Thereby, the driving assistance device 1 can determine whether the hazardous event received from the vehicle 20 was caused by the driving operation of the driver of the vehicle or the traveling environment, and can support appropriate safe driving by feeding back the determination result to the driver.

Figure 4:
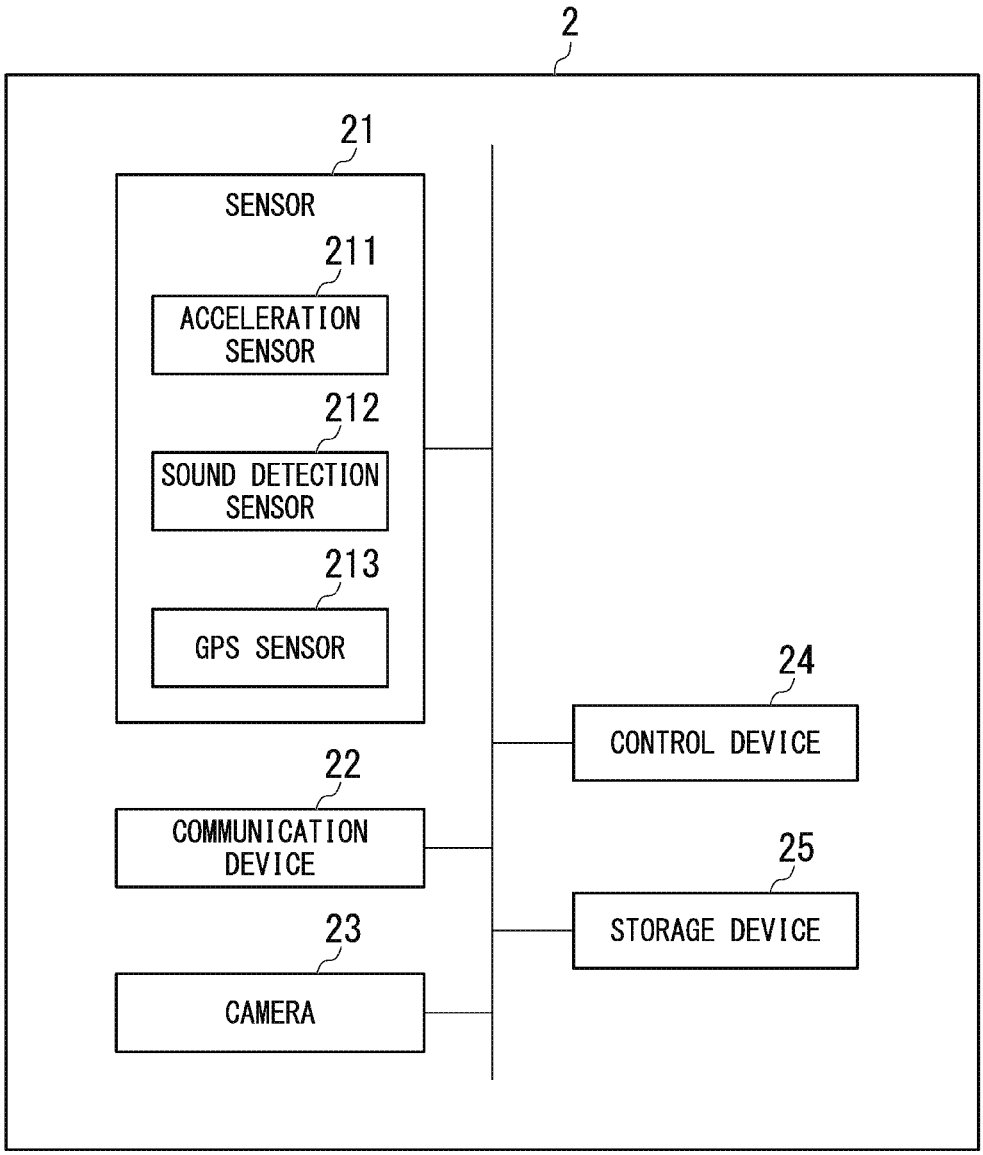
FIG. 4 is a diagram showing a hardware configuration of the drive recorder according to the present embodiment.

FIG. 4 is a diagram showing a hardware configuration of the drive recorder.

The drive recorder 2 is provided with a sensor 21, a communication device 22, a camera 23, a control device 24, a storage device 25, and the like. The sensor 21 may include an acceleration sensor 211, a sound detection sensor 212, a GPS sensor 213, or the like. The sensor 21 is installed at any position on the vehicle outside the drive recorder 2, whereby the drive recorder 2 may acquire information sensed by the sensor 21.

The communication device 22 is communication-connected with the driving assistance device 1. The camera 23 captures an image of the outside of the vehicle to generate a moving image and a still image. The camera 23 may further capture an image of the interior of the vehicle. However, the image used in the present embodiment is an image generated by imaging the outside of the vehicle showing the traveling environment including a road, the road surface, the road shoulder of the traveling road, travel regulation devices such as a sign or a traffic light, and the like.

The control device 24 controls each function of the drive recorder 2. The storage device 25 stores sensing information including moving images, still images, and various types of information sensed by the sensor 21. The drive recorder 2 is communication-connected with the driving assistance device 1 through a base station or the like. The control device 24 of the drive recorder 2 is a computer provided with a CPU, ROM, RAM, and the like.

Figure 5:
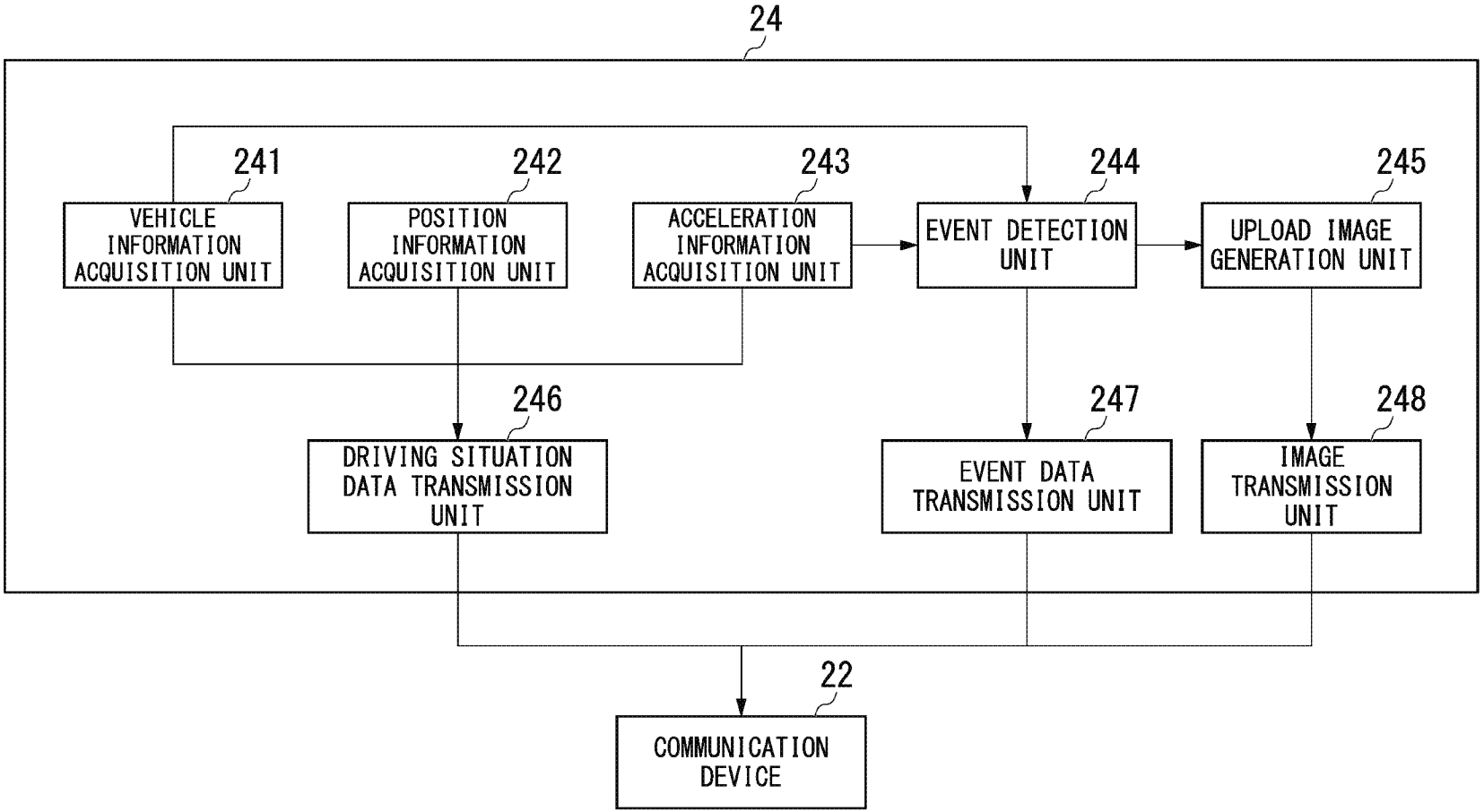
FIG. 5 is a function block drawing of a control device of the drive recorder according to the present embodiment.

FIG. 5 is a function block drawing of a control device provided in the drive recorder.

The control device 24 executes a control program when the drive recorder 2 is activated. Accordingly, the control device 24 is provided with the functions of a vehicle information acquisition unit 241, a position information acquisition unit 242, an acceleration information acquisition unit 243, an event detection unit 244, an upload image generation unit 245, a driving situation data transmission unit 246, an event data transmission unit 247, and an image transmission unit 248.

The vehicle information acquisition unit 241 acquires vehicle information including information (driver ID, vehicle type, vehicle ID) related to the vehicle 20 recorded in a memory inserted in the drive recorder 2. Vehicle information that can be acquired by the vehicle information acquisition unit 241 may further include information such as a driving start time, a driving stop time, vehicle speed corresponding to time, in-vehicle temperature, steering wheel angle, and brake depression amount.

The position information acquisition unit 242 acquires position information (latitude information, longitude information) of the vehicle according to time from the GPS sensor 213 or the like.

The acceleration information acquisition unit 243 acquires acceleration information of the vehicle according to time from the acceleration sensor 211.

The event detection unit 244 determines whether or not a predetermined event has occurred in the vehicle on the basis of acceleration or the like. The predetermined event is, for example, a hazardous event, and may also be an event such as sudden acceleration or sudden deceleration.

The upload image generation unit 245 acquires image data including at least one of a moving image and a still image from the camera 23 by image capture performed by the camera 23, and generates and outputs captured images for upload at a predetermined interval on the basis of the image data. For example, the upload image generation unit 245 generates captured images at a generation speed of 1 frame per second, and generates captured images at a generation speed of 30 fps at the time an event is detected by the event detection unit 244.

The driving situation data transmission unit 246 transmits to the driving assistance device 1 driving situation data including vehicle information, position information (latitude information, longitude information), acceleration, speed, steering wheel rotation angle, brake depression amount, generation time of the driving situation data, ID of the drive recorder 2, and driver ID. The driving situation data is information used for detecting the driving situation of the vehicle 20. The driving situation data is, for example, information related to a situation of the vehicle 20 and driving operation. The driving situation data may be transmitted to the driving assistance device 1 together with the event data or included in the event data.

The event data transmission unit 247 transmits hazardous event data when the event detection unit 244 detects the occurrence of an event. Acceleration, speed, steering wheel rotation angle, brake depression amount, event occurrence time, vehicle position information (latitude information, longitude information), ID of the drive recorder 2, and driver ID at the time of event occurrence detection may be included in the hazardous event data. The hazardous event data may further include other sensing information. The hazardous event data may include an identifier indicating the type of event.

The image transmission unit 248 transmits captured images generated by the upload image generation unit 245 to the driving assistance device 1.

The driving assistance device 1 stores in advance in a database 106 or the like a deterioration information table that associates a position (latitude, longitude) specifying a deteriorated portion in a traveling environment that has occurred on a travelling road such as a road on which the vehicle 20 travels, the deterioration type, and the deterioration degree. A deterioration information table that associates the position of the deteriorated portion, deterioration type, and deterioration degree included in the deterioration information table is created in advance by an administrator and recorded in the database 106 or the like.

The deterioration information table may be generated using uploaded images received by the driving assistance device 1 from the drive recorder 2 of each vehicle 20 or the position information of the vehicle 20 at the capture timing of each image. For example, the driving assistance device 1 analyzes the uploaded image and, using an automatic determination algorithm, specifies a predetermined monitoring target that influences deterioration of the traveling environment of the vehicle 20 and calculates the deterioration degree of the monitoring target.

FIG. 6A to FIG. 6C are a diagram for explaining the deterioration degree of the traveling environment.

The monitoring targets are cracks, potholes, ruts and the like in roads. These monitoring targets influence the deterioration of the traveling environment of the vehicle 20. The monitoring target may also be a travel regulation device such as a sign or a traffic light.

FIG. 6A is a diagram showing the deterioration degree of cracks. FIG. 6B is a diagram showing the deterioration degree of potholes. FIG. 6C is a diagram showing the deterioration degree of ruts. The monitoring target is also referred to as a deterioration type. As shown in FIG. 6A, if the monitoring target is the crack, the driving assistance device 1 classifies and specifies the deterioration degree thereof into one of "low", "medium", and "high" in accordance with the crack ratio at a predetermined range of the road surface. As shown in FIG. 6B, if the monitoring target is the pothole, the driving assistance device 1 classifies and specifies the deterioration degree thereof into one of "low", and "high" in accordance with the size presence of the pothole. As shown in FIG. 6C, if the monitoring target is the rut, the driving assistance device 1 classifies and specifies the deterioration degree thereof into one of "low", "medium", and "high" in accordance with the depth (digging amount) of the rut. The deterioration degree held in the deterioration information table is information specified by such classification.

FIG. 7A and FIG. 7B are a diagram showing determination tables.

The determination tables shown in FIG. 7A and FIG. 7B are used for determining whether a hazardous event is caused by a driving operation of the driver or the traveling environment. Specifically, recorded in the determination table is cause information that specifies whether a hazardous event was caused by a driving operation of the driver or the traveling environment in accordance with the type of hazardous event determined on the basis of hazardous event data and the deterioration degree of a monitoring target at the position where the hazardous event occurred. The determination table may be information generated for each monitoring target. For example, the first determination table indicated by FIG. 7A is a determination table when the monitoring target is a "crack". A second determination table indicated by FIG. 7B is a determination table when the monitoring target is a "pothole".

FIG. 7 A and FIG. 7B illustrate determination tables in which cause information is associated with a correspondence relation between the type of hazardous event and the deterioration degree of the traveling environment at the position where the hazardous event has occurred. The determination table is not limited to this example. The cause information may differ depending on a hazard degree of the hazardous event. For example, the case where the hazard degree of the crack is "low" is described. In this case, when the hazard degree of the hazardous event is "high", it is determined that the hazardous event has occurred due to the driving operation of the driver, and when the hazard degree is "low", it is determined that the hazardous event has occurred due to the driving environment.

As described above, a determination table in which the cause information is associated with a correspondence relation between the hazard degree of the hazardous event and the deterioration degree of the traveling environment at the position where the hazardous event has occurred may be prepared. Also, a determination table in which the cause information is associated with a correspondence relation between the type, hazard degree of the hazardous event, and the deterioration degree of the traveling environment at the position where the hazardous event has occurred may be prepared.

Figure 8:
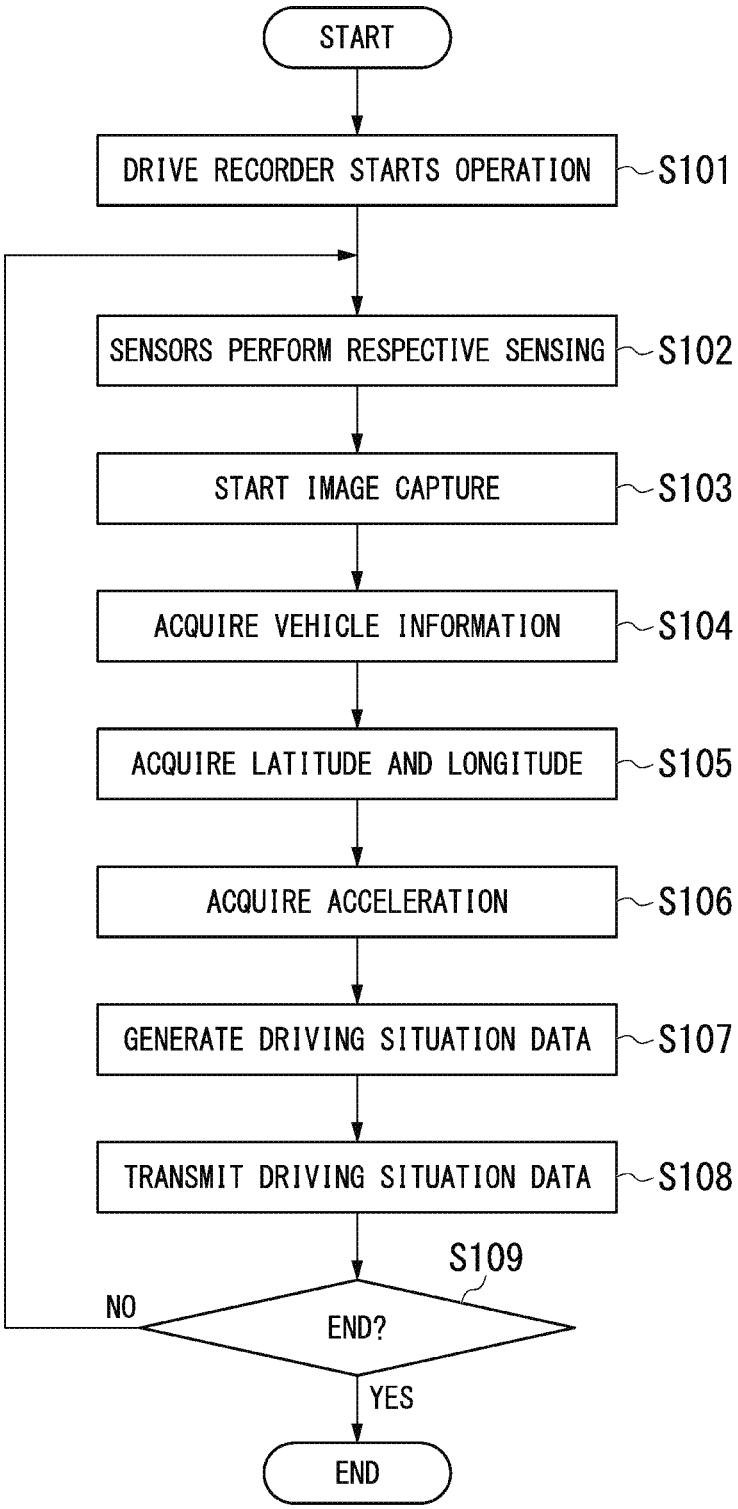
FIG. 8 is a first diagram showing the processing flow of the drive recorder according to the present embodiment.

FIG. 8 is a first diagram showing a processing flow of the drive recorder.

Next, the processing flow of the drive recorder 2 will be described in sequential order.

First, the process of transmitting the driving situation data in the drive recorder 2 will be described.

When the electrical system of the vehicle is activated, the drive recorder 2 starts operation (Step S101). The respective sensors 21 of the drive recorder 2 starts various types of sensing after the drive recorder 2 is started (Step S102). The camera 23 starts capturing images (Step S103). During operation of the drive recorder 2, the vehicle information acquisition unit 241 of the control device 24 acquires vehicle information (Step S104). The position information acquisition unit 242 acquires position information (latitude information and longitude information) from the GPS sensor 213 at a predetermined time interval (Step S105). The acceleration information acquisition unit 243 acquires acceleration information from the acceleration sensor 211 at a predetermined time interval (Step S106). The predetermined time interval may be, for example, every 0.1 second. The driving situation data transmission unit 246 acquires vehicle information, position information (latitude information, longitude information), and acceleration information, and generates driving situation data that includes such items of information, the generation time of the driving situation data, the ID of the drive recorder 2, and the driver ID (Step S107). The driving situation data transmission unit 246 requests the communication device 22 to transmit the driving situation data to the driving assistance device 1. The communication device 22 transmits the driving situation data to the driving assistance device 1 (Step S108). The control device 24 determines whether or not the process has ended (Step S109), and repeats the process from Step S102 until the process ends.

Figure 9:
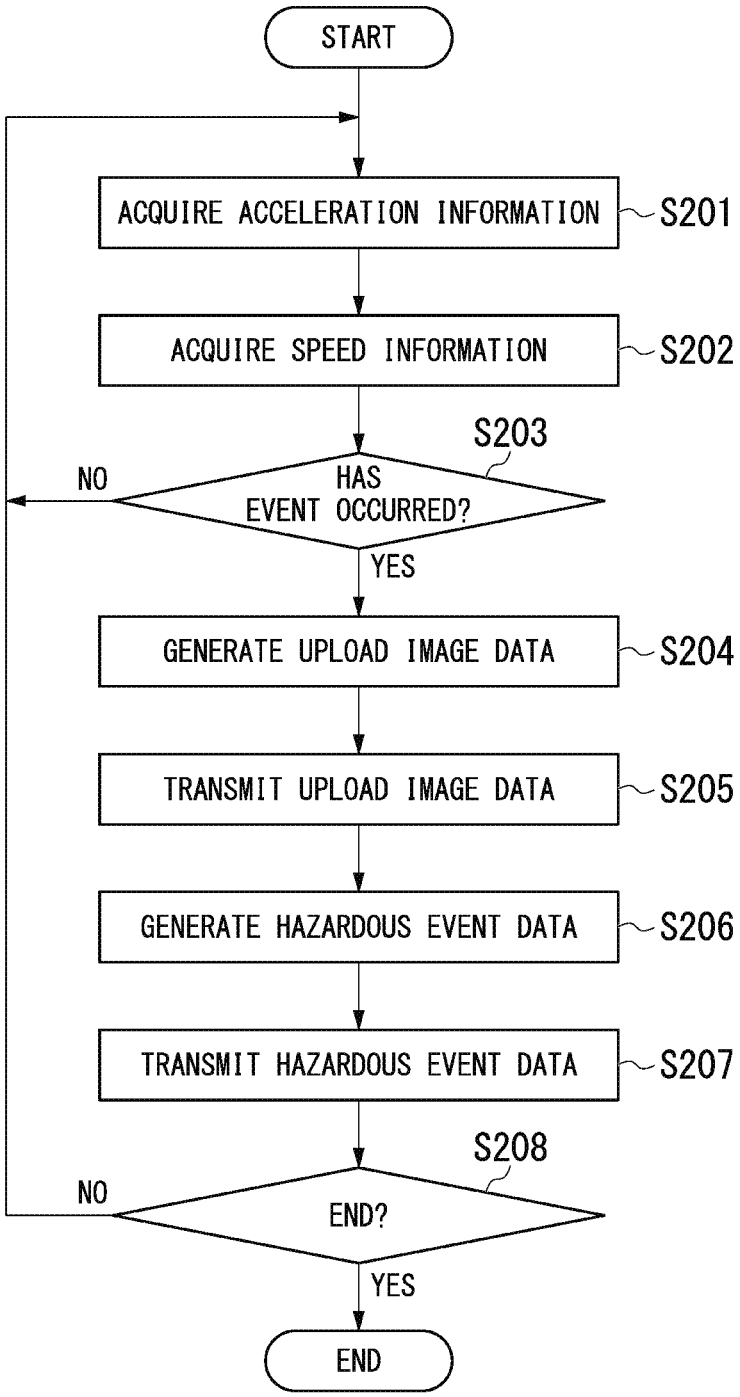
FIG. 9 is a second diagram showing the processing flow of the drive recorder according to the present embodiment.

FIG. 9 is a second diagram showing the processing flow of the drive recorder.

The drive recorder 2 performs an event detection process in parallel with the process of transmitting the driving situation data. First, when the drive recorder 2 starts, the event detection unit 244 of the control device 24 acquires acceleration information from the acceleration information acquisition unit 243 at a predetermined time interval (Step S201). Further, the event detection unit 244 acquires speed information from the vehicle information acquisition unit 241 at a predetermined time interval (Step S202). The event detection unit 244 detects whether or not an event has occurred in the vehicle on the basis of the acceleration and changes over time in speed of the vehicle (Step S203). An event is an event indicating a hazardous phenomenon in the present embodiment.

Detection of whether or not this event has occurred may be determined according to a driver attribute. The driver attribute is, for example, an ID of the drive recorder 2 or the driver ID. Even if a similar driving situation occurs, the determination result indicating whether or not the hazardous event has occurred may differ depending on the ID of the drive recorder 2 or the driver ID. Therefore, for example, the occurrence of the hazardous event can be detected more flexibly for each driver. Alternatively, the occurrence of the hazardous event can be detected more flexibly for each vehicle.

Also, the event detection unit 244 may detect whether or not the hazardous event has occurred in the vehicle on the basis of the acceleration direction in addition to the acceleration or speed change over time.

Here, an example of detection processing for determining whether the hazardous event has occurred will be described. Specifically, the event detection unit 244 acquires operation condition data. Hazard degree level information included in this operation condition data has, for example, an operation flag for each acceleration corresponding to a hazard degree. Hazardous driving-type information included in the operation condition data has, for example, an operation flag for each acceleration direction condition and speed condition corresponding to the type of hazardous driving.

The event detection unit 244 detects the occurrence of a hazardous event when the acquired acceleration becomes acceleration of a hazard degree indicating "1", and the acquired acceleration direction or speed match an acceleration direction or speed condition of a hazardous driving type indicating "1". Also, the event detection unit 244 may also detect the occurrence of a hazardous event when at least either the acquired acceleration becomes acceleration of a hazard degree indicating "1", or the acquired acceleration direction or speed match an acceleration direction or speed condition of a hazardous driving type indicating "1". Since the operation flags held in the hazard level information and the hazardous driving-type information are set according to the driver attribute, it is possible to detect the occurrence of a hazardous event on the basis of the driver attribute.

Thus, the event detection unit 244 detects the occurrence of the hazardous event when the acceleration of the vehicle 20 is equal to or greater than a predetermined hazard level. In addition, the event detection unit 244 may detect the occurrence of the hazardous event when the acceleration direction or speed of the vehicle 20 matches a predetermined condition. Alternatively, the event detection unit 244 may detect the occurrence of the hazardous event when the acceleration direction or speed satisfy a predetermined condition in addition to the acceleration of the vehicle 20.

When the event detection unit 244 has detected the occurrence of a hazardous event, the event detection unit 244 instructs the upload image generation unit 245 to generate upload image data. The upload image generation unit 245 acquires a moving image captured by the drive recorder 2. When the upload image generation unit 245, upon receiving a detection signal of the occurrence of a hazardous event from the event detection unit 244, generates the upload image data on the basis of the acquired moving image (Step S204).

Specifically, the upload image generation unit 245 generates a still image or a moving image having a predetermined playback time. The number of still images, the capture time of each still image based on the hazardous event occurrence time, the playback time of the moving image, the time matching the moving image start timing of the moving image based on the hazardous event occurrence time, and the like may be determined in accordance with the driver attribute.

The upload image generation unit 245 outputs the upload image data including the generated still images or moving image, the generation time, the ID of the drive recorder 2, and the driver ID to the image transmission unit 248. The image transmission unit 248 transmits the upload image data to the driving assistance device 1 via the communication device 22 (Step S205).

The event detection unit 244 generates hazardous event data upon detecting the occurrence of a hazardous event (Step S206). The hazardous event data may include the acceleration, speed, steering wheel rotation angle, brake depression amount, hazardous event occurrence time, position information of vehicle 20 (latitude information, longitude information), ID of the drive recorder 2 and driver ID. The hazardous event data may include other sensing information as well.

The hazardous event data is not limited to this example. The hazardous event data may include, for example, information regarding speed or information on driving operation in addition to the position information. The information regarding the speed includes at least one of acceleration, speed, and acceleration direction. The information regarding the driving operation includes at least one of the steering wheel rotation angle, brake depression amount.

The event data transmission unit 247 acquires the hazardous event data from the event detection unit 244. The event data transmission unit 247 instructs the communication device 22 to transmit the hazardous event data to the driving assistance device 1. The communication device 22 transmits the hazardous event data to the driving assistance device 1 (Step S207). The control device 24 determines whether or not the process has ended (Step S208), and repeats the process from Step S202 until the process ends.

Figure 10:
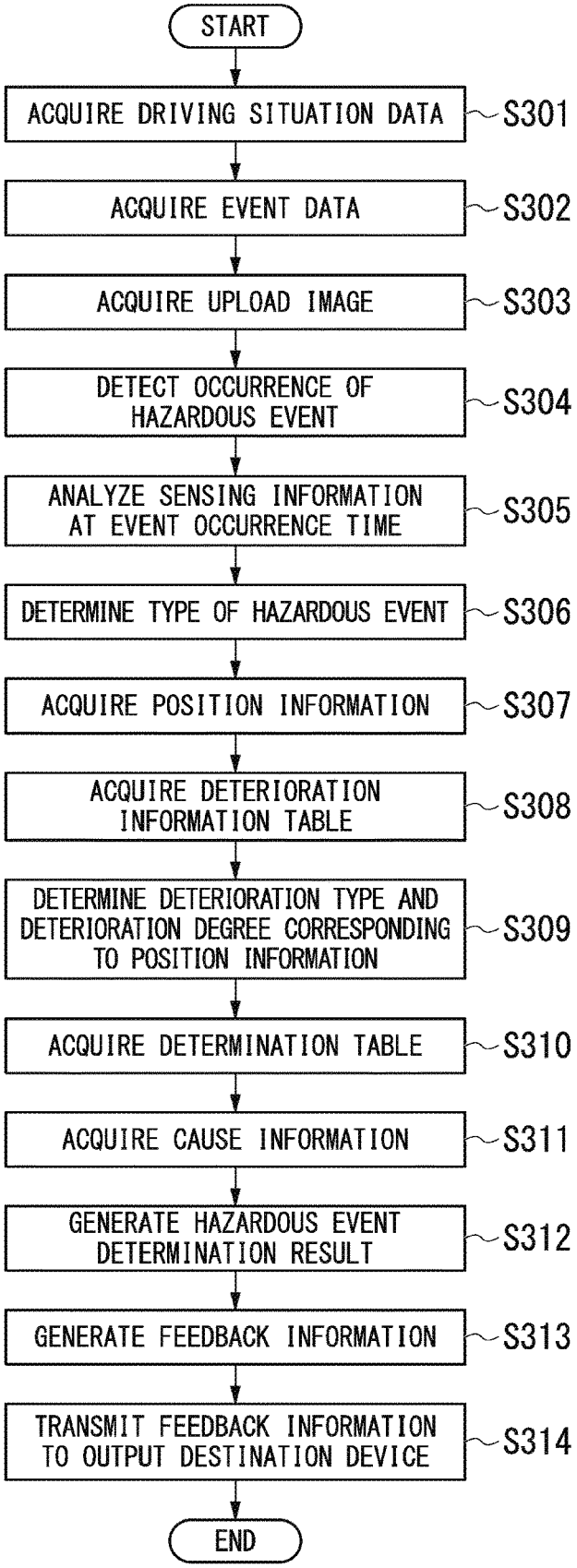
FIG. 10 is a diagram showing the processing flow of the driving assistance device.

FIG. 10 is a diagram showing the processing flow of the driving assistance device.

In the driving assistance device 1, the first acquisition unit 12 acquires the driving situation data transmitted by the communication device 22 of the vehicle 20 via the communication module 105 (Step S301). The first acquisition unit 12 acquires the hazardous event data transmitted by the communication device 22 of the vehicle via the communication module 105 (Step S302). The first acquisition unit 12 acquires the uploaded image transmitted by the communication device 22 of the vehicle via the communication module 105 (Step S303).

The determination unit 14 acquires driving situation data and hazardous event data. The determination unit 14 detects the occurrence of a hazardous event in the vehicle equipped with the drive recorder 2 on the basis of the hazardous event data (Step S304). If hazardous event data could be acquired, the determination unit 14 indicates that a hazardous event has occurred.

When the determination unit 14 detects the occurrence of a hazardous event, the determination unit 14 analyzes the sensing information at period when the hazardous event occurred (hazardous event occurrence period) on the basis of the time of the hazardous event occurrence (Step S305). For example, the hazardous event occurrence period may be one minute before and after based on the time of the hazardous event occurrence. The determination unit 14 calculates the hazardous event occurrence period specified by each time one minute before and one minute after based on the time of day of the hazardous event occurrence, and extracts from the currently or previously received driving situation data the sensing information (vehicle information, position information, acceleration, speed, steering wheel rotation angle, brake depression amount, and the like) at that hazardous event occurrence period. Alternatively, the determination unit 14 may acquire the latest sensing information regardless of the hazardous event occurrence period.

The determination unit 14 acquires the ID of the drive recorder 2 or driver ID included in the hazardous event data. The determination unit 14 acquires an analysis condition stored in advance in association with the ID of the drive recorder 2 or the driver ID. Since the analysis condition is specified by the ID of the drive recorder 2 and the driver ID, for example, the analysis condition according to a company or individual driver using the drive recorder 2 mounted in a vehicle can be obtained. The ID of the drive recorder 2 and driver ID are one aspect of information indicating driver attributes.

On the basis of the analysis condition, the determination unit 14 analyzes the sensing information extracted from the driving situation data on the basis of the hazardous event occurrence period (hereinafter, extracted information), and determines the type of the hazardous event (Step S306).

For example, when a difference between the steering wheel rotation angle included in the hazardous event data received this time and the steering wheel rotation angle included in the hazardous event data received the previous time is greater than or equal to a predetermined angle, the determination unit 14 determines the hazardous event to be of the type indicating a sudden hazardous steering wheel operation by the driver (the driver of the vehicle 20). For example, when the acceleration direction included in the hazardous event data received this time is the vertical direction of the vehicle 20 and the acceleration is greater than or equal to a predetermined threshold value, the determination unit 14 determines the hazardous event to be of the type indicating that the vehicle has traveled over a position with a bump. The determination unit 14 may determine the type of the hazardous event using other sensing information as well. The determination unit 14 may determine the hazardous event to be of the type indicating a sudden acceleration or a sudden start, when the acceleration included in the hazardous event data received this time greater than or equal a predetermined threshold value. The determination unit 14 may determine the hazardous event to be of the type indicating a sudden deceleration or a sudden stop, when the acceleration included in the hazardous event data received this time is a negative value that is less than or equal a predetermined threshold value.

The determination unit 14 instructs the second acquisition unit 13 to acquire the determination table. The second acquisition unit 13 acquires position information (latitude, longitude) included in the hazardous event data (Step S307).

The second acquisition unit 13 acquires a deterioration information table recorded in the database 106 in association with the latitude and longitude indicated by the position information (Step S308). As described above, in the deterioration information table, a position (latitude, longitude) specifying a deteriorated portion of the traveling environment that has occurred on the travelling road, the deterioration type, and the deterioration degree are recorded in association with each other. The second acquisition unit 13 determines the deterioration type and the deterioration degree corresponding to the position information on the basis of the deterioration information table (Step S309). That is, it is possible to determine the deterioration type and the deterioration degree of the deteriorated portion determined on the basis of the position information by the hazardous event data transmitted by the drive recorder 2 of the vehicle 20.

The second acquisition unit 13 acquires the determination table (FIG. 7) recorded in the database 106 on the basis of the deterioration type and the deterioration degree (Step S310). The second acquisition unit 13 outputs the determination table to the determination unit 14.

In the determination table, the determination unit 14 acquires cause information recorded in the determination table on the basis of the hazardous event type determined in Step S306 and the deterioration degree determined in Step S309 (Step S311). The cause information acquired by the determination unit 14 indicates whether the occurrence of the hazardous event of the hazardous event type determined in Step S306 was caused by a driving operation of the driver or the traveling environment. The determination unit 14 generates a hazardous event determination result including sensing information that includes the drive recorder ID, driver ID, position information, and the like, the hazardous event type, and the cause information (Step S312). The determination unit 14 outputs the hazardous event determination result to the recording unit 15. The recording unit 15 records the hazardous event determination result in the database 106 or the like.

The process of the determination unit 14 described above is an example of a processing mode of determining whether a hazardous event indicated by the hazardous event data was caused by a driving operation of the driver of the vehicle 20 or the traveling environment, on the basis of the correspondence relation between a type indicated by the hazardous event data and the deterioration degree of the traveling environment.

As shown in FIG. 7, the determination unit 14 determines whether a hazardous event indicated by the hazardous event data was caused by a driving operation of the driver of the vehicle 20 or the traveling environment, on the basis of the determination table for each deterioration type (monitoring target). This process of the determination unit 14 is an example of a processing mode of determining whether a hazardous event indicated by the hazardous event data was caused by a driving operation of the driver of a vehicle or the traveling environment, on the basis of a correspondence relation between the type indicated by the hazardous event data and the deterioration degree of the traveling environment, which differs for each deterioration type of the traveling environment.

The determination table may include a correspondence relation between the hazard degree of the hazardous event and the deterioration degree of the traveling environment. The determination unit 14 determines whether the hazardous event indicated by the hazardous event data was caused by a driving operation of the driver of a vehicle or the traveling environment, on the basis of a correspondence relation between the hazard degree indicated by the hazardous event data and the deterioration degree of the traveling environment.

As for the deterioration type determined in Step S309 described above, when there is an abnormality in a travel regulation device such as a sign or traffic signal or road marking at the latitude and longitude indicated by the location information at which the hazardous event data was transmitted, a deterioration type such as "deterioration of sign", "deterioration of road marking" and the like may be determined.

In this case, a determination table corresponding to this deterioration type is recorded in the database 106, and the second acquisition unit 13 acquires the determination table based on an instruction from the determination unit 14. Thereby, the determination unit 14 can acquire cause information indicating whether the hazardous event indicated by the hazardous event data was caused by a driving operation of the driver of the vehicle or the traveling environment on the basis of the determination table corresponding to the deterioration type such as "sign deterioration" or "road marking deterioration".

Through the above processing, it is possible to record a hazardous event determination result indicating information on whether the transmission of the hazardous event data transmitted from the drive recorder 2 was caused by the driving operation of the driver or the traveling environment. Thereby, the driving assistance device 1, using this hazardous event determination result, can generate feedback information using only the hazardous event data transmitted from the drive recorder 2 due to a driving operation of the driver, and can support appropriate safe driving by the driver by feeding back the determination result to the driver.

The feedback information generation unit 16 generates feedback information using the hazardous event determination result that was recorded (Step S313). The feedback information may be a list including position information items where hazardous events occurred, hazardous event types, the value of each sensor indicated by the sensing information and the like for each driver ID. The feedback information may also be map data in which an icon indicating a hazard is displayed in position information included in all the hazardous event determination results. The feedback information generation unit 16 outputs the feedback information to the output unit 17. The output unit 17 transmits the feedback information to a predetermined output destination device (Step S314).

Figure 11:
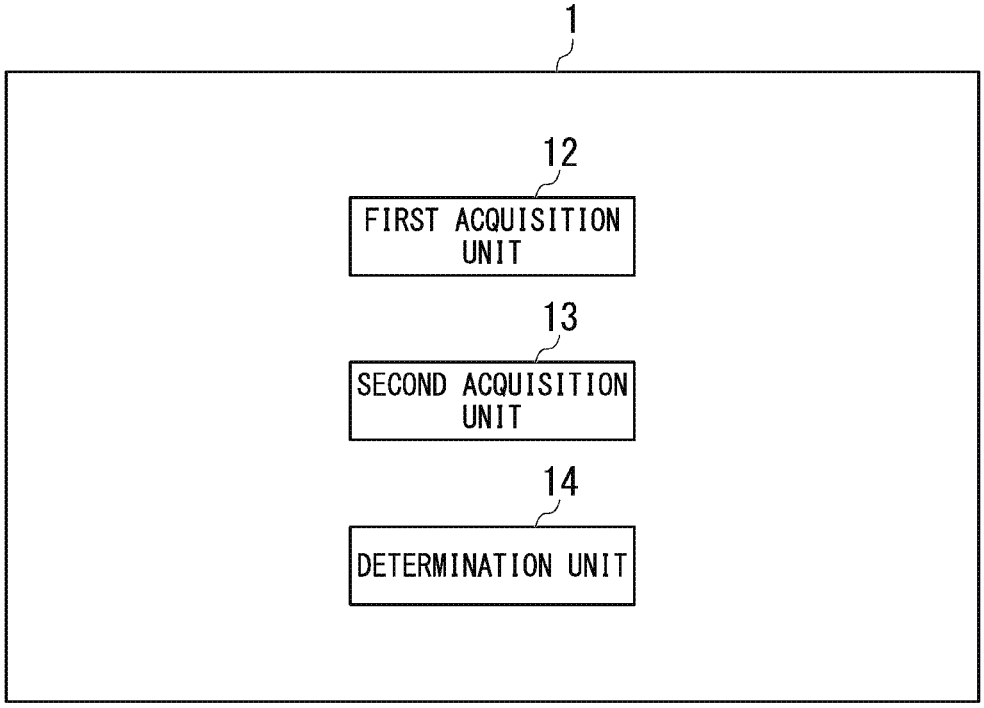
FIG. 11 is a diagram illustrating a minimum configuration of the driving assistance device according to the present embodiment.

FIG. 11 is a diagram illustrating a minimum configuration of the driving assistance device.

As shown in this figure, the driving assistance device 1 is provided with at least a first acquisition unit 12, a second acquisition unit 13, and a determination unit 14.

The first acquisition unit 12 acquires hazardous event data notifying the occurrence of a hazardous event during driving from a driving condition sensing device provided in the vehicle.

The second acquisition unit 13 acquires deterioration information of the traveling environment recorded in advance in association with a position where a driving situation sensing device sensed the hazardous event data.

The determination unit 14 determines whether a hazardous event indicated by the hazardous event data was caused by a driving operation of the driver of the vehicle or the traveling environment, on the basis of the hazardous event data and the deterioration information of the of the traveling environment.

The above-described driving assistance device 1 and the control device 24 of the drive recorder 2 have a computer system inside. Each process described above is stored in a computer-readable recording medium in the form of a program, and the above process is performed by the computer reading and executing the program.

The program may be one for realizing a part of the functions described above. Further, the program may be a file, a so-called differential file (differential program), that can realize the above-described functions in combination with a program already recorded in the computer system.

While preferred embodiments of the invention have been described and illustrated above, it should be understood that these are exemplary of the invention and are not to be considered as limiting. Additions, omissions, substitutions, and other modifications can be made without departing from the spirit or scope of the present invention. Accordingly, the invention is not to be considered as being limited by the foregoing description, and is only limited by the scope of the appended claims.

What is claimed is:

1. A driving assistance device comprising:

a memory storing computer program instructions; and a processor configured to:

acquire hazardous event data for notifying the occurrence of a hazardous event indicating a hazardous driving during driving from a driving situation sensing device provided in a vehicle;

acquire a deterioration degree of a traveling environment registered in advance in association with a position where the driving situation sensing device senses the hazardous event data; and determine, on a basis of the hazardous event and the deterioration degree of the traveling environment, whether a hazardous event indicated by the hazardous event data was caused by a driving operation of the driver of the vehicle or the traveling environment, wherein the processor is further configured to determine, on a basis of a correspondence relation between a hazard type/degree indicated by the hazardous event data and the deterioration degree of the traveling environment, which is different for each deterioration type of the traveling environment, whether the hazardous event indicated by the hazardous event data was caused by the driving operation of the driver of the vehicle or the traveling environment.

2. The driving assistance device according to claim 1, wherein the deterioration degree of the traveling environment includes the deterioration degree of a road surface on which the vehicle is traveling.

3. The driving assistance device according to claim 1, wherein the deterioration degree of the traveling environment includes the deterioration degree of a travel regulation device provided on the road surface on which the vehicle is traveling.

4. A driving assistance method comprising the steps of:

acquiring hazardous event data for notifying the occurrence of a hazardous event indicating a hazardous driving during driving from a driving situation sensing device provided in a vehicle;

acquiring a deterioration degree and a deterioration type of a traveling environment registered in advance in association with a position where the driving situation sensing device senses; and determining, on a basis of the hazardous event and the deterioration degree of the traveling environment, whether a hazardous event indicated by the hazardous event data was caused by a driving operation of the driver of the vehicle or the traveling environment, wherein the determining comprises determining, on a basis of a correspondence relation between a hazard type/degree indicated by the hazardous event data and the deterioration degree of the traveling environment, which is different for each deterioration type of the traveling environment, whether the hazardous event indicated by the hazardous event data was caused by the driving operation of the driver of the vehicle or the traveling environment.

5. A non-transitory computer-readable recording medium storing a program that causes a computer of a driving assistance device to perform processes, the processes comprising:

acquiring hazardous event data for notifying the occurrence of a hazardous event during driving from a driving situation sensing device provided in a vehicle;

acquiring a deterioration degree and a deterioration type of a traveling environment registered in advance in association with a position where the driving situation sensing device senses the hazardous event data; and determining, on a basis of the hazardous event and the deterioration degree of the traveling environment, whether a hazardous event indicated by the hazardous event data was caused by a driving operation of the driver of the vehicle or the traveling environment, wherein the determining comprises determining, on a basis of a correspondence relation between a type or a hazard type/degree indicated by the hazardous event data and the deterioration degree of the traveling environment, which is different for each deterioration type of the traveling environment, whether the hazardous event indicated by the hazardous event data was caused by the driving operation of the driver of the vehicle or the traveling environment.

6. The driving assistance device according to claim 1, wherein the hazardous event indicates that the amount of change in the state of the vehicle is equal to or greater than a predetermined threshold value.

7. The driving assistance device according to claim 1, wherein the processor is further configured to:

determine, on the basis of the hazard type indicated by the hazardous event data and the deterioration degree of the traveling environment, whether the hazardous event indicated by the hazardous event data was caused by the driving operation of the driver of the vehicle or the traveling environment.

* * * * *